United States Patent [19]

Geissler et al.

[11] 4,226,178

[45] Oct. 7, 1980

[54] HOT-AIR GRILLS

[75] Inventors: Hans-Juergen Geissler, Frankfurt am Main; Peter Mueller, Debring; Manfred Oppelt, Mistendorf; Horst Schoener, Bamberg; Franz A. Stuetzer, Mühlheim am Main, all of Fed. Rep. of Germany

[73] Assignee: Rowenta-Werke, GmbH, Offenbach am Main, Fed. Rep. of Germany

[21] Appl. No.: 7,534

[22] Filed: Jan. 29, 1979

[30] Foreign Application Priority Data

Feb. 4, 1978 [DE] Fed. Rep. of Germany ..... 2804817

[51] Int. Cl.[3] ..... A47J 27/00

[52] U.S. Cl. ..... 99/447; 99/474; 126/21 A

[58] Field of Search ..... 99/474, 372, 376, 377, 99/403, 446–447, 448, 483; 126/21 A; 219/400

[56] References Cited

U.S. PATENT DOCUMENTS

| | | | |
|---|---|---|---|
| 2,044,615 | 6/1936 | Kennedy | 99/376 X |
| 2,134,828 | 11/1938 | Kaplan et al. | 99/376 X |
| 2,211,940 | 8/1940 | Stoner | 126/21 A X |
| 3,245,800 | 4/1966 | Sanders | 99/403 X |
| 3,501,620 | 3/1970 | Sauer | 126/21 A X |
| 3,626,922 | 12/1971 | Borge | 126/21 A |
| 3,658,047 | 4/1972 | Happel | 126/21 A |
| 3,780,721 | 12/1973 | Durth | 126/21 A |
| 3,827,346 | 8/1974 | Tropp et al. | 99/446 |
| 4,010,341 | 3/1977 | Ishammar | 126/21 A X |
| 4,034,663 | 7/1977 | Jenn et al. | 99/446 |

*Primary Examiner*—Philip R. Coe
*Assistant Examiner*—Arthur O. Henderson
*Attorney, Agent, or Firm*—George R. Clark; Neil M. Rose; Allen J. Hoover

[57] ABSTRACT

An electrical hot air grill includes a control and stand unit, a blower and heating unit, a grilling compartment bounded by two shells, a device for supporting articles to be grilled in the grilling compartment and an apertured plate mounted on the blower and heating unit and arranged between the blower and heating unit and the grilling compartment.

7 Claims, 3 Drawing Figures

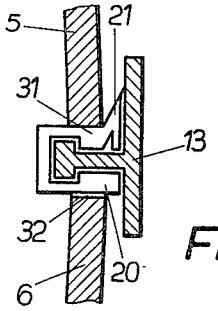
Fig. 3
Fig. 1
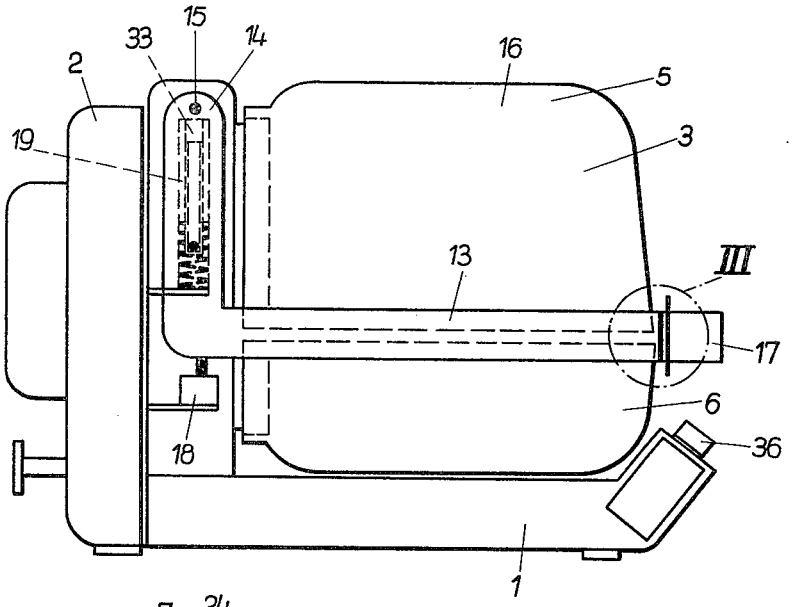
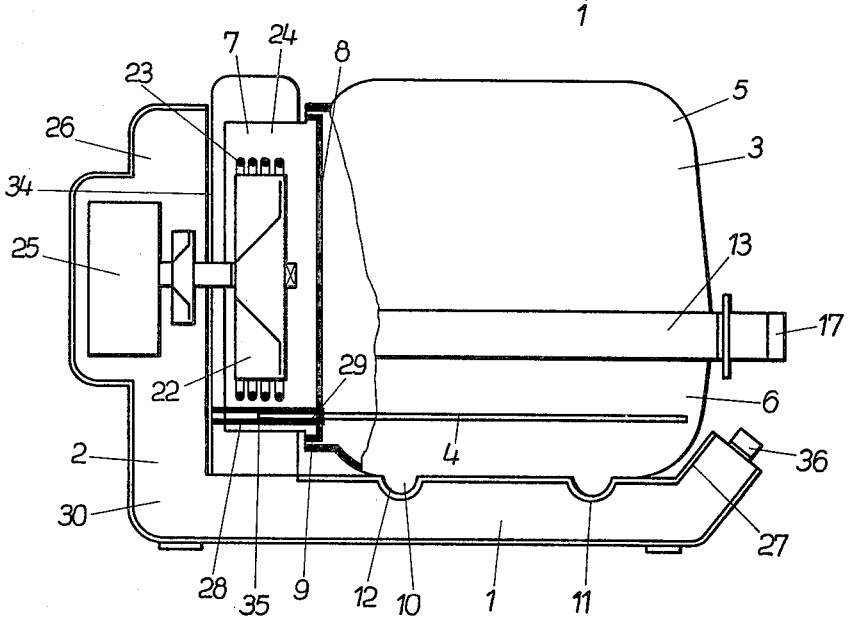
Fig. 2

HOT-AIR GRILLS

This invention relates to an electrical hot-air grill comprising a control and stand unit, a blower and heating unit, and a grilling compartment.

Electrical hot-air grilling appliances of this type are known (German Patent Specification 25 55 522). With these appliances the grilling compartment consists of a retort, made in one piece, whose front side is closed by a cover plate. Both the retort and the control and blower unit are mounted rigidly on a stand. The operating elements are arranged on the blower and control unit. This has the disadvantage that the operating elements are accessible only with difficulty and are not easily supervised. When these grilling appliances are operated during the grilling process, the risk of combustion on the retort heated up to 300° C. is very great. A further disadvantage of these appliances consists in that the cleaning of the grilling compartment after grilling presents the same difficulties as with almost all known grilling appliances or domestic ovens. The cleaning of these appliances is facilitated for the consumer due to the fact that the inner walls are coated with a material having a self-cleaning effect or are lined with a replaceable aluminium foil. Also known is a hot-air grill with a grilling compartment consisting of two congruent half shells of glass (German utility model 77 23 185). This appliance has the advantage that the half shells can be cleaned thoroughly after the grilling process, but its great disadvantage is that the upper half shell must be lifted off from the lower half shell in order to open the grilling compartment. During the grilling process the very hot upper half shell cannot be opened, for example, to sprinkle the article being grilled with oil, without prejudicing the cooking action.

An object of this invention is to provide an electrical hot-air grill which reduces the above-mentioned disadvantages and with which, while preserving economic production, the grilling-compartment shells forming the grilling compartment as well as the appliance parts arranged within the grilling compartment can be cleaned without difficulty and, moreover, whose grilling compartment can be opened safely during the grilling process and whose operating elements are arranged in an easily accessible and clearly visible manner.

According to the invention, there is provided an electrical hot-air grill comprising a control and stand unit; a blower and heating unit; a grilling compartment bounded by at least two shells; means for supporting articles to be grilled in the grilling compartment; and an apertured plate mounted on the blower and heating unit and arranged between the blower and heating unit and the grilling-compartment. The apertured plate, which may define nozzles for hot air from the blower and heating unit, is preferably arranged with at least its lower side on the inside of the grilling compartment. According to a further preferred feature of the invention, at least two sleeves open towards the grilling compartment and passing through the apertured plate are mounted in the blower and heating unit. The lower grilling-compartment shell preferably has at least one locating or locking cam. A recess adapted to receive the cam is arranged in the control and stand unit and in the assembled state the cam of the lower grilling-compartment shell engages with the recess. The face of the control and stand unit adjacent the grilling compartment preferably has an inclined face and at least one of the cams is preferably shaped as a ladle to receive cooking juices. At least one hinged arm is preferably mounted on the blower and heating unit, a pivotable frame being mounted on the or each arm, the frame extending substantially horizontally and parallel to the control and stand unit and holding an upper grilling-compartment shell. The pivot of the or each hinged arm is preferably arranged at such a level with respect to the top edge of the upper grilling compartment shell, adjacent the heating unit, that when the upper grill compartment shell is raised or lowered no part will extend beyond the back-side edges of the lower shell. The frame is preferably provided with a handle and the frame is preferably connected operatively to a switch for the blower and heating unit. At least one hinged arm is preferably connected operatively to a spring, the force of the spring being equal to or less than the weight of the upper grilling-compartment shell. Between the opposing faces of the grilling-compartment shells is preferably arranged a gasket which is mounted releasably on the frame. The upper region of the gasket is preferably provided with an inclined centring face. Finally, the blower and heating unit preferably comprises two parts, a fan wheel and a heating element being arranged in a hot part and a motor for the fan arranged in a cold part, while the heating element is preferably fastened releasably and/or pivotably in the hot part.

Owing to the preferred features of the invention it is ensured that after the grilling process the housing parts bounding the grilling compartment as well as the appliance parts, such as the means for supporting articles to be grilled and the apertured plate, provided on the inside of the grilling compartment can be removed from the appliance without it being necessary to release a fastening element, in order then to clean them in a washing machine or by hand. Owing to the arrangement of the pivotable hinged arms, the upper grilling-compartment shell is pivotable upwardly away from the lower grilling-compartment shell. The grilling compartment can thus be opened easily and safely at any time, even during the grilling process. When the upper grilling-compartment shell is raised, the condensate precipitated on the inner wall does not drop onto the outer wall of the appliance, but directly into the lower grilling-compartment shell owing to the arrangement of the pivot. With proper handling, combustion on the very hot grilling-compartment shells is not possible. A further advantage arising from the preferred features of the invention consists in that the operating controls, projecting beyond the front side of the appliance, are arranged precisely in the field of vision of the user. The operating elements are thereby readily accessible and the adjusted values can be read off easily. The danger that the user may unintentionally come in contact with the hot parts of the appliance when operating the appliance is eliminated.

An exemplary embodiment of the invention is described in detail hereinafter by reference to FIGS. 1 and 3 wherein:

FIG. 1 is a side view of a hot-air grill according to the invention in the region of a hinged arm, FIG. 2 is a partly cutaway side view of the hot-air grill shown in FIG. 1, and FIG. 3 is an enlarged section at III in FIG. 1.

The hot-air grill shown by way of example consists of a control and stand unit 1, a blower and heating unit 2 and a grilling compartment 3 bounded by two grilling-compartment shells 5 and 6. The control and stand unit 1 and blower and heating unit 2 together form an L-shaped chassis 30. Provided in the control and stand unit 1 are recesses 11 which receive locking cams 10 of the lower grilling-compartment shell 6, by virtue of which the lower grilling-compartment shell 6 is mounted releasably on the control and stand unit 1. It is advantageous if one locking cam 10 is made large enough for it to serve simultaneously as a receptacle 12 for juices originating from the article being cooked. A frame 13 is provided with two hinged arms 14 which are hinged pivotably about a pivot 15 on the blower and heating unit 2. The pivot 15 is arranged either substantially on a level with or higher than the top edge 16 of the upper grilling-compartment shell 5 on the blower and heating unit 2. The back-side lower edge of the upper grilling-compartment shell 5 thereby always moves, while it is being swung up, within the inner region of the lower grilling-compartment shell 6. Condensate precipitated within the upper grilling-compartment shell 5 thus cannot drop from any point onto the outer wall of the appliance. The upper grilling-compartment shell 5 is mounted releasably in a frame 13. A gasket 20 is provided on the frame 13. When the grilling compartment 3 is closed, this gasket 20 lies between the opposed faces 31,32 of the grilling-compartment shells 5,6. The sealing action is effected by the dead weight of the upper grilling-compartment shell 5 and the frame 13. The gasket 20 has a centring incline 21 in its uper region. The upper grilling-compartment shell 5 can be swung up about the pivot 15 by means of a handle 17 provided on the frame 13. A spring 19 whose elastic force is equal to or less than the weight of the upper grilling-compartment shell 5 is connected operatively to one of the hinged arms 14 via a sliding block 33, so that the closing movement of upper grilling-compartment shell 5 is cushioned.

A switch 18 which may be a microswitch is mounted so as to be operated by one of the hinged arms 14. When the grilling compartment 3 is opened, the hinged arm 14 is taken out of operative connection to the switch 18, due to which the blower and the heating element are switched off. When the upper grilling-compartment shell 5 is removed from the frame 13, the frame 13 is lifted due to the force of the spring 19, so that the hinged arm 14 is not in contact with the switch 18. When the grilling-compartment shell 5 is removed, the hot-air grill is thus automatically switched off.

A fan wheel 22 and a heating element 23 are fastened releasably in a pressure space 7 within the blower and heating unit 2. An apertured plate 8 is fastened resiliently and releasably to the pressure space 7 between the grilling-compartment shells 5 and 6 and the blower and heating unit 2. Possible spacing variations between the grilling-compartment shells 5,6 and the blower and heating unit 2 are thereby compensated. These variations are caused by manufacturing tolerances on the grilling-compartment shells 5,6. The blower and heating unit 2 is divided by a partition 34 and thereby forms a hot part 24 and a cold part 26 containing a blower motor 25. Supporting sleeves 28 are mounted on the blower and heating unit 2. Thee supporting sleeves 28 pass through the apertured plate 8 in the region of openings 29. Supporting pins 35 situated on the means for supporting articles to be cooked are pushed into the supporting sleeves 28, by means of which the grill grid is mounted in the grilling compartment 3. Where several supporting pins 35 are arranged vertically above one another, it is possible to accommodate several supporting means 4 in the grilling compartment 3, so that the foodstuffs placed on the supporting means 4 can be prepared in single cooking process. Also mounted on the front side of the control and stand unit 1, provided with inclined face 27, are the controls 36 of the hot-air grill.

We claim:

1. In an electrical hot-air grill of a type comprising a chassis, a grilling compartment supported on the chassis and bounded by an upper shell and a lower shell, which may be separated from each other to open the grilling compartment, a blowing and heating apparatus mounted on the chassis and arranged to blow hot air into the grilling compartment, an improvement wherein the upper shell is supported removably on a frame, which is mounted pivotally to the chassis, so as to be removable from the frame without it being necessary to release a fastening element and so as to be pivotable up and down about a transverse axis, which is located so as to provide that the grilling compartment is opened when the upper shell thus is pivoted up and closed when the upper shell thus is pivoted down and that condensate dripping from the inner side of the upper shell tends to drip mostly into the lower shell but not onto outer portions of the electrical hot-air grill when the grilling compartment is opened.

2. The improvement of claim 1 wherein the frame extends substantially horizontally when the grilling compartment is closed.

3. The improvement of claim 2 wherein the frame is mounted pivotally to the chassis substantially on a level not lower than the uppermost portions of the upper shell.

4. The improvement of claim 2 or 3 wherein a gasket is supported on the frame so as to separate the upper shell and the lower shell when the grilling compartment is closed and wherein the upper shell rests on and may be lifted off the gasket.

5. The improvement of claim 4 wherein the gasket has a face that is inclined so as to center the upper shell within the gasket.

6. The improvement of claim 2 or 3 wherein the lower shell rests on the chassis and may be lifted off the chassis when the grilling compartment is opened, and wherein the lower shell comprises at least one cam, which fits into a recess in the chassis so as to locate the lower shell when the lower shell rests on the chassis and which is shaped as a ladle so as to receive juices in the lower shell.

7. The improvement of claim 2 or 3 wherein an apertured plate is mounted on the blowing and heating apparatus and arranged between the blowing and heating apparatus and the grilling compartment so as to be removable from the blowing and heating apparatus without it being necessary to release a fastening element.

* * * * *